US005271199A

United States Patent [19]

Northern

[11] Patent Number: 5,271,199

[45] Date of Patent: Dec. 21, 1993

[54] POST TENSIONING ANCHOR SYSTEM

[75] Inventor: Ronald D. Northern, Gulf Breeeze, Fla.

[73] Assignee: Incast Anchorage Systems, Inc., Gulf Breeze, Fla.

[21] Appl. No.: 935,057

[22] Filed: Aug. 24, 1992

[51] Int. Cl.[5] ..... E04C 3/10

[52] U.S. Cl. ..... 52/223.13; 52/223.7; 24/122.6

[58] Field of Search ..... 52/223 L, 223 R, 230, 52/223.7, 223.13, 223.14; 24/122.6

[56] References Cited

U.S. PATENT DOCUMENTS 3,225,500 12/1965 Martter ..... 52/230
3,833,706 9/1974 Edwards .
3,936,256 2/1976 Howlett et al. ..... 52/223 R
4,348,844 9/1982 Schupack et al. .
4,616,458 10/1986 Davis et al. .
4,621,943 11/1986 Swanson .
4,718,209 1/1988 Hansen et al. .
4,719,658 1/1988 Kriofske .
4,773,198 9/1988 Reinhardt .
4,799,307 1/1989 Reigstad et al. .
4,821,474 4/1989 Rodriguez ..... 52/223 L
4,896,470 1/1990 Sorkin .
5,072,558 12/1991 Sorkin et al. ..... 52/230

*Primary Examiner*—Carl D. Friedman
*Assistant Examiner*—Christopher T. Kent
*Attorney, Agent, or Firm*—Needle & Rosenberg

[57] ABSTRACT

The present invention provides a post tensioning anchor system having a tensioning tendon for securement in a concrete structure with an anchor plate dimensioned to receive the same sized fitting on both faces thereof, and a cap for placement on either face of the anchor plate to prevent deterioration of the tendon anchorage.

20 Claims, 4 Drawing Sheets

POST TENSIONING ANCHOR SYSTEM

BACKGROUND OF THE INVENTION

The general purpose of the invention is to provide a post tensioning system having an alternate means of encapsulating tendon anchorages that requires fewer parts and less labor to install, and provides superior encapsulation results.

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produce an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its greatest potential when it is used in pre-stressed or post-tensioned members. Spans as great as 100 feet can be attained in members as deep as three feet for roof loads. The basic principal is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Pre-stressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

Metallic components within concrete structures may become exposed to many corrosive elements, such as de-icing chemicals, sea water, brackish water, or spray from these sources, as well as salt water. If this occurs, and the exposed portions of the anchor suffer corrosion, then the anchor may become weakened due to this corrosion. The deterioration of the anchor can cause the tendons to slip, thereby losing the compressive effects on the structure, or the anchor can fracture. In addition, the large volume of byproducts from the corrosive reaction is often sufficient to fracture the surrounding structure. These elements and problems can be sufficient so as to cause a premature failure of the post-tensioning system and a deterioration of the structure.

There are four general types of prior art systems for protecting post-tensioning anchor systems from deterioration and failure:

(1) Rodriguez (U.S. Pat. No. 4,821,474) teaches an anchor plate assembly having collar regions on both sides for the attachment of caps or tubular members to cover and seal the tendon anchored within the anchor plate. On the side of the anchor plate intended to face the concrete the collar region has a smaller outside diameter than the collar region of the side facing the concrete form. On the side of the anchor facing the concrete form the larger collar region has an inner wall and an outer wall region. An annular groove is formed between the inner and outer walls that is adapted to receive the tubular member or cap. This system has the disadvantage of requiring the machining of the annular groove in the larger collar region, which increases the cost and complexity of Rodriguez's anchor plate. Rodriguez also calls for optional securing filaments in the form of wires or plastic straps, which secure the tubular member and cap to the anchor plate. Connecting ears formed on opposite sides of tubular member receive the optional filaments therearound. In the practice of the design taught by Rodriguez, the securing filaments are not optional, but are required to prevent the tubular members and caps from falling off the anchor plate during use. This is disadvantageous because it requires additional parts and labor to install the post tensioning anchors.

(2) The system described in Reinhardt (U.S. Pat. No. 4,773,198) utilizes an anchor plate with threads machined into the inside face of a collar for receiving a threaded cap. The Reinhardt anchor plate also has a differently shaped collar on the opposite side of the anchor plate for receiving a connector. This system has the disadvantage that different attachments must be used on opposite sides of the anchor plate, thus, increasing the difficulty of installing the system and adding to the cost of the system. This system has the further disadvantage of requiring machine tooled threads on both the anchor plate and the cap, which add to the cost of the system. A still further disadvantage of the system is that the threads on the cap and anchor can be stripped during installation, thus, preventing proper protection for the tendon anchorage.

(3) Another system, sold by VSL Corporation (Campbell, Calif.), uses snap-on caps to cover the tensioning tendon on the wedge side of the anchor plate. This system operates by means of a flange on the cap, which snaps into a groove on the inside of the collar. This system also requires the use of two different attachments to fit different sized collars on opposite sides of the anchor plate. The use of a snap on cap has the further disadvantages of requiring that the anchor plate be machined to include the annular groove inside the collar into which the flange of the cap fits.

(4) Other systems taught by Sorkin (U.S. Pat. No. 4,896,470) and Davis et al. (U.S. Pat. No. 4,616,458) require the complete coverage of the anchor plate with plastic. Sorkin calls for encapsulation by molding plastic around the anchor plate with a cap being inserted inside a collar region on the wedge side of the anchor plate. In the Davis et al. system, a molded plastic top member for covering the entire front face of the anchor plate snap fits onto a molded plastic bottom member that covers the entire rear face of the anchor plate. The Davis et al. system requires extensive manipulation of the top and bottom members to make them fit securely around the anchor plate and has the disadvantage of increased labor costs. Both of the above-described encapsulation systems have the disadvantage that the wedge faces thereof are subject to melting when excess tendon is cut off with a torch, which can cause failure of the encapsulation.

With the exception of Rodriguez, all of the prior art systems have the disadvantage of having the cap attached inside the collar, which can permit water, carrying corrosive compounds, to enter the collar and seep into contact with the tendon and wedges. All of the prior art systems have the further practical and cost disadvantages of requiring different parts for attachment to opposite sides of the anchor plate.

SUMMARY OF THE INVENTION

The disadvantages of the prior art are overcome by the present invention which has the same dimensions on both faces of the anchor plate that allows one size cap to be used for all conditions. The cap is modified during the molding process to be blocked off and, thus, become a cap for sealing the tendon assembly. Alternatively, the cap can be open ended for use on the concrete-facing side of the anchor. This cap works exclusively on the principle of friction and eliminates the need for threads or snaps. Therefore, the present system is easier to manufacture and install.

The anchor plate of the present system is simple and inexpensive to cast and is adapted to receive the same attachments on both faces of the anchor plate. Further advantages of the present design result from the caps for both faces of the anchorage being frictionally fit to the outside surface of the anchor collars, thus, providing simple attachment and superior protection of the tendon anchorage from the environment.

DESCRIPTION OF THE FIGURES OF DRAWINGS

DETAILED DESCRIPTION OF THE INVENTION

Figure 1:
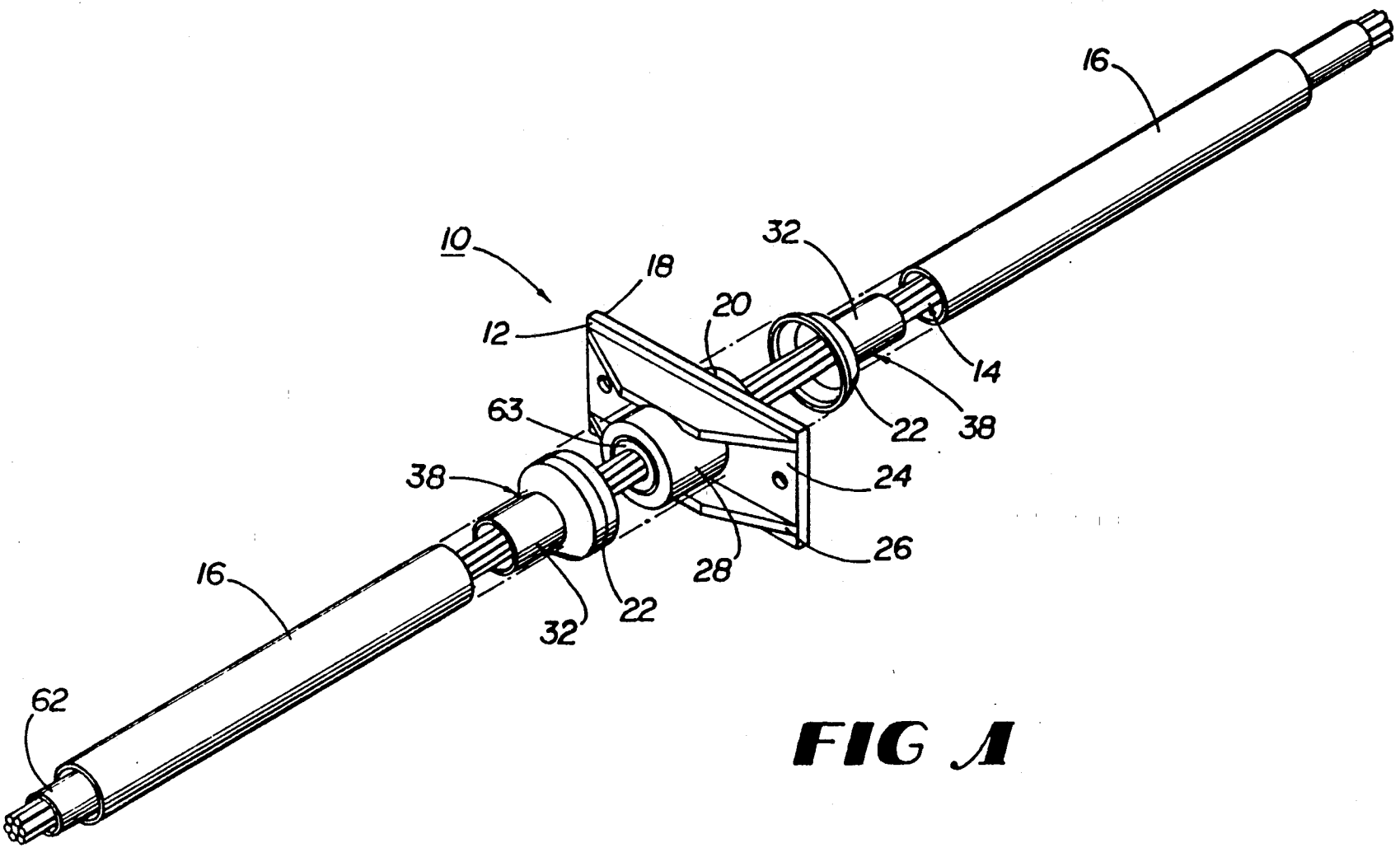
FIG. 1 is an exploded perspective view of the post tensioning anchor system, according to the present invention, used as an intermediate anchorage.

Referring first to FIG. 1, there is shown an exploded perspective view of an anchor plate assembly constructed in accordance with the principles of the present invention. The anchor plate assembly 10 comprises a generally rectangular anchor plate 12 through which a sheathed post-tensioning tendon 14 extends. The tendon 14 of FIG. 1 is shown extending through the anchor plate 12 for purposes of illustration. The tendon 14 is further shown disposed within caps 38, which attach to a front face 24 and the rear face 18 of the plate 12. The tendon is also shown passing through tubular members 16, which attach to caps 38. It is the rear face 18 of anchor plate 12 that applies the tensioning force to a concrete structure by means of the post-tensioning tendon 14.

The anchor plate 12 is constructed with a central bore 30 (shown more clearly in FIG. 2) formed therethrough having a first cylindrical collar 20 on the rear face 18 and a second cylindrical collar 28 on the front face 24. The first and second collars 20, 28 are concentrically and peripherally aligned with each other and have substantially equivalent outside diameters, the outside diameters being substantially equivalent to an inside diameter of cap 38. The cap 38 is secured about collar regions 20, 28 extending, respectively, from the rear (first) face 18 and from front (second) face 24 of the plate 12 in sealed engagement to protect the tendon 14 therein. Thereafter, tubular members 16 can be frictionally attached to caps 38 for the passage of the tensioning tendon therethrough. In the embodiment using tubular members 16, the closed end 36 of cap 38 is either cup open to permit the passage of tendon 14 or the end of tendon 14 is forced through end 36 of cap 38.

Referring still to FIG. 1, a cylindrical cup shaped region 22 of enlarged diameter is provided at one end of each cap 38 for engagement of the cylindrical collars 20, 28 in slip fit frictional attachment relationship. The cylindrical cup shaped region 22 of cap 38 is adapted to fit in press fit, frictional engagement with the cylindrical collars of the plate 12. Cup region 22 is thus formed with an inside diameter only slightly larger or slightly smaller than the outside diameter of collars 20, 28 such that a frictional engagement is facilitated. The inside of cup region 22 also includes one or more annular ridges for increasing the friction between the cap and the outside diameter of collars 20, 28. Appropriate sealing compounds and the like are used upon the cable 14 and between the collars 20, 28 and caps 38 as is conventional in the art of post-tensioning systems whereby the tendons 14 are sealed from the concrete and from other sources of corrosion. Cap 38 also has a hollow tubular region 32 connected to the cup shaped region 22 and concentrically aligned therewith. The hollow tubular region 32 of cap 38 has an inside diameter adapted to receive a tensioning tendon therethrough when cap 38 is engaged with one of the cylindrical collars 20,28. This unitary construction of cap 38 permits a tubular member 16 to frictionally engage the outside diameter of the hollow tubular region 32 of cap 38 for extended coverage of tensioning tendon 14.

Still referring to FIG. 1 there is shown the front face 24 of the anchor plate 12. The front face 24 of the present embodiment is constructed with a series of gussets 26 tapering downwardly from cylindrical collar 28. This face can be formed without gussets 26 as needed for the particular application. The cylindrical collar 28 is in axial and peripheral alignment with cylindrical collar 20, which together define bore 30 through anchor plate 12, whereby tendon 14 may be received therein.

Figure 3:
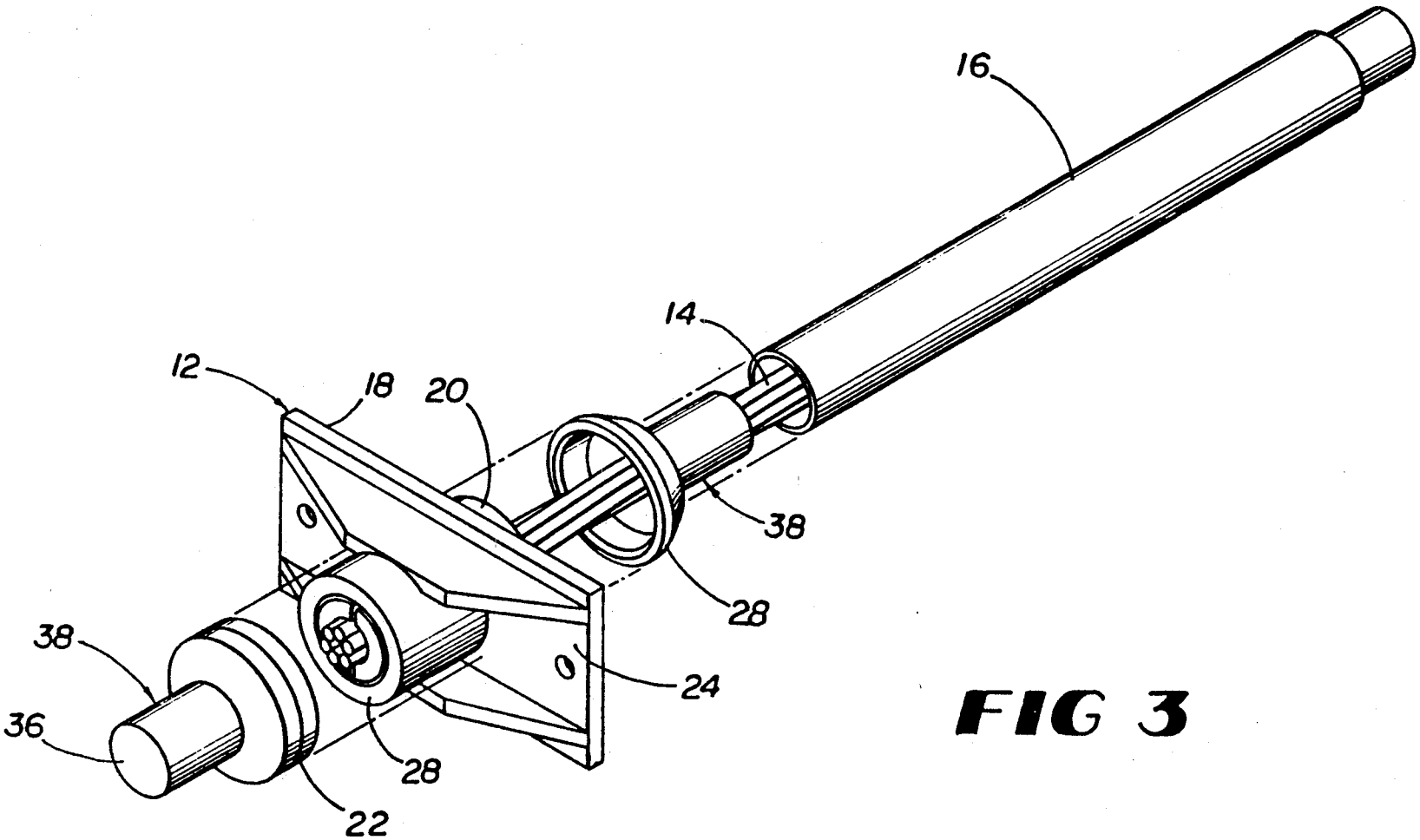
FIG. 3 is an exploded perspective view of the post tensioning anchor system, according to the present invention, used as a terminal anchorage.

Referring to FIGS. 1 and 3, the anchor plate 12 may be adapted for use as a terminal anchor plate of a concrete structure or as an intermediate anchor plate due to the feasibility for receiving the caps 38 and tubular members 16 on both faces thereof. When used as a terminal anchorage for a post-tensioning tendon (FIG. 3), the first (rear) face 18 will have cap 38 attached to collar 20 with a tubular member 16 attached to cap 38 and the tendon 14 passing therethrough. This assembly will then be mounted to the pour form with the second (front) face 24 adjacent the form. After the concrete pouring and tendon tensioning steps, the form is removed and the excess tendon extending out through collar 28 on the front face 24 of anchor plate 12 is cut, usually by torch. After the cutting step, grease or other suitable sealing compound is applied to the outside of the cylindrical collar 28 and cap 38 is attached thereto by frictional engagement.

FIG. 1 illustrates the present system used as an intermediate anchorage. The system is very similar to the terminal anchorage, except that tendon 14 is not cut after tensioning, but extends onward from anchor plate 12 to the next anchor plate. To protect this intermediate anchorage, cap 38 and tubular member 16 are attached to cylindrical collar 28 with the tensioning tendon therein, before concrete is poured adjacent to face 24 of anchor plate 12.

Figure 2:
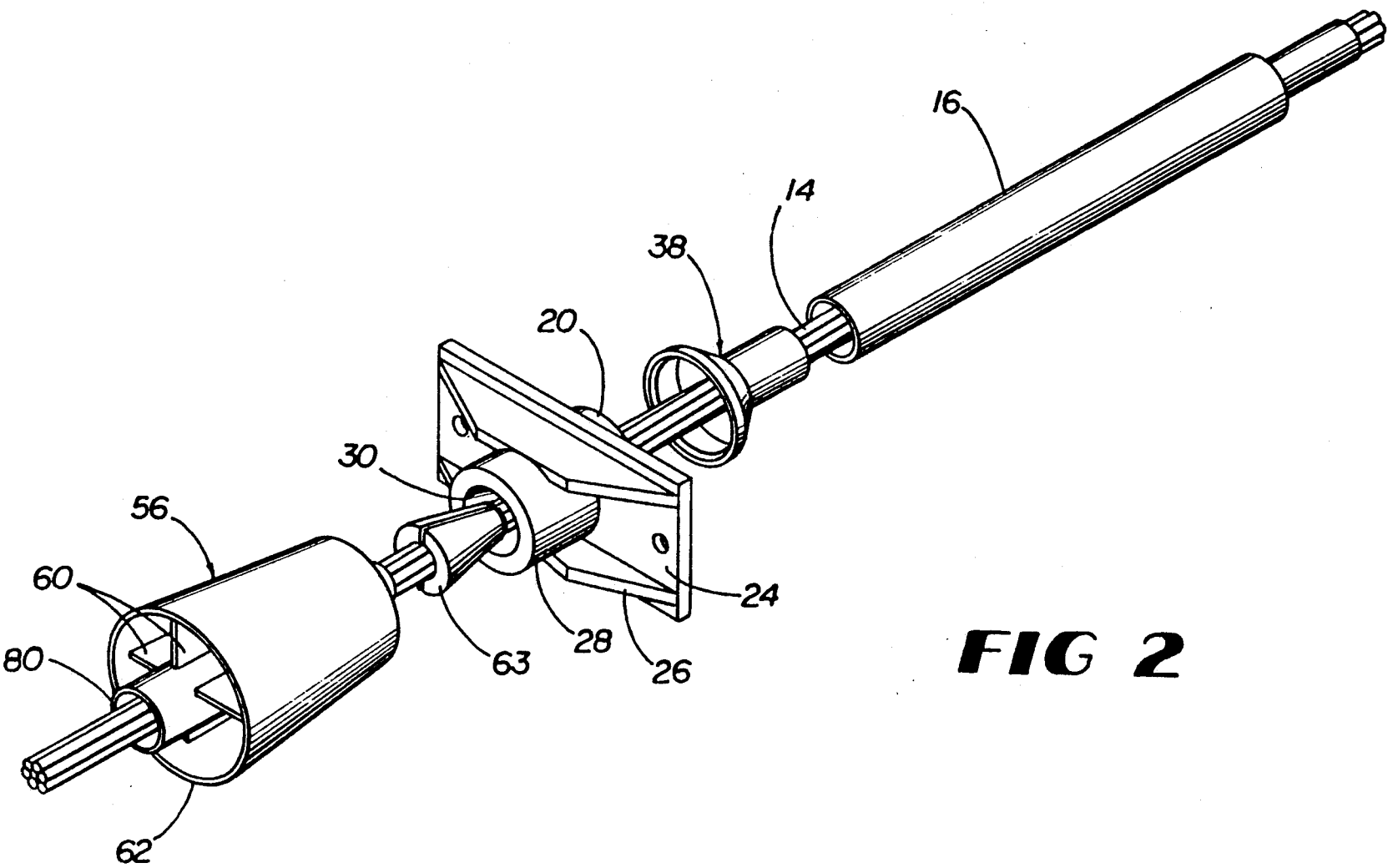
FIG. 2 is a pre assembled perspective view of the post tensioning anchor system, showing the pocket former, according to the present invention.
Figure 4:
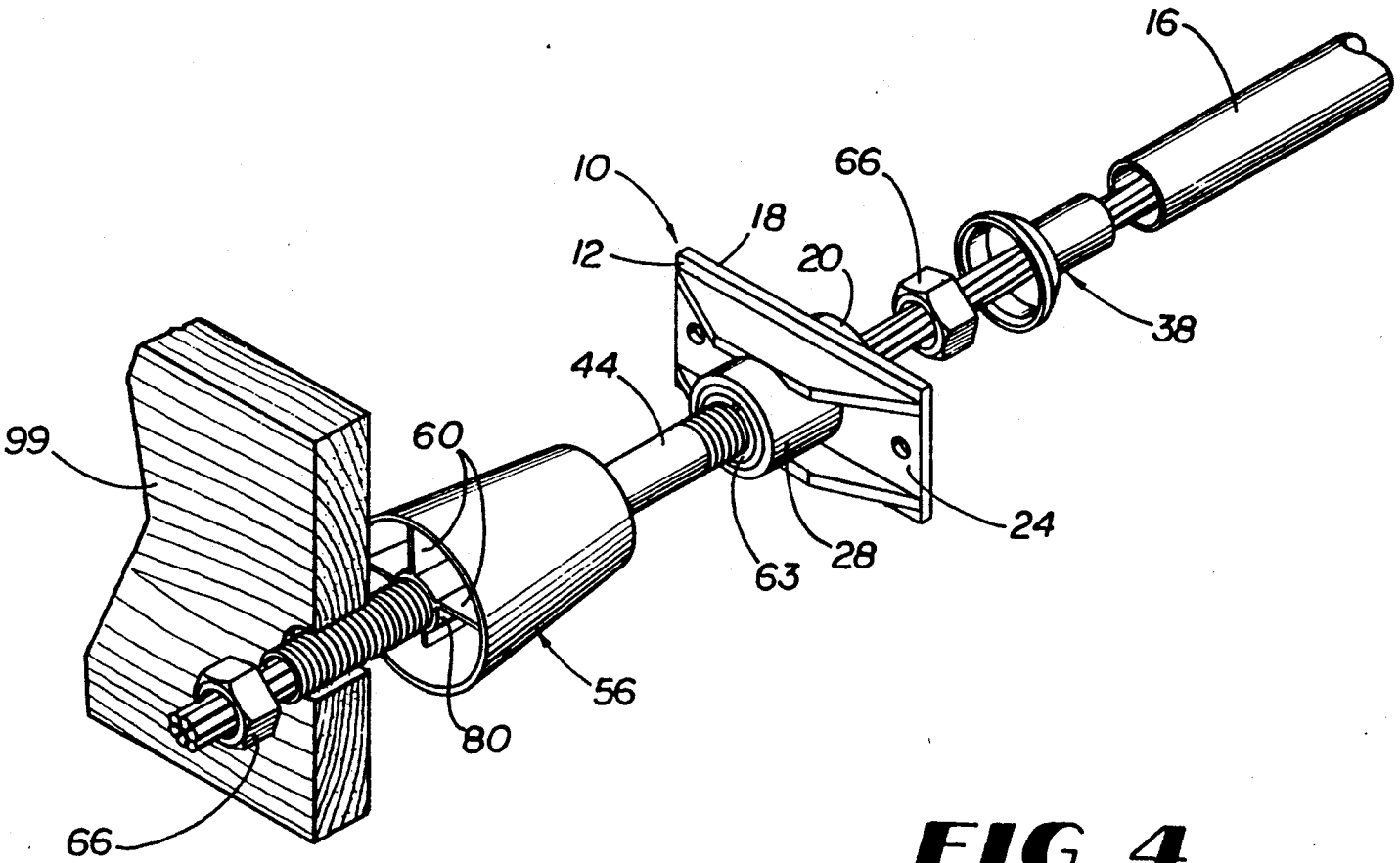
FIG. 4 is a pre-assembled perspective view of the post tensioning anchor system showing the threaded mounting tube, according to the present invention.

FIGS. 2 and 4 show pocket former 56, according to the present invention. Pocket former 56 provides advantages over the prior art because it is dimensioned to fit around the outside of collar 28, rather than inside the collar as previously taught. The effectiveness of cap 38 in protecting the tendon anchorage therein is enhanced by the frictional engagement of cap 38 with the outside diameter of collar 28 as described above.

Still referring to FIGS. 2 and 4, it can be seen that pocket former 56 also serves the conventional purpose of allowing anchor plate 12 and tendon 14 to be accessed after the concrete has set and form 99 is removed, for the purposes of tensioning and grouting. Pocket former 56, according to the present invention, may be more easily removed to access plate 12 because pocket former 56 is slidably received by mounting tube 44 rather than forming a portion of tube 44 or being otherwise attached thereto. This arrangement alleviates the necessity of being required to torque the mounting tube 44 in order to overcome frictional forces between pocket former 56 and the concrete structure and cylindrical collar 28 of anchor plate 12. Instead, pocket former 56 may first be removed and then mounting tube 44 may be removed.

Pocket former 56 is preferably frusto-conical in shape and is formed of PVC or other suitable polymeric or other type material as are other components of the anchorage, including cap 38, mounting tube 44, nut 66 and tubular member 16. In the preferred embodiment, pocket former 56 includes an inner ring 80 for slidably receiving spindle 44. Inner ring 80 is connected by radial vanes 60 to outer ring 62 forming the outer, and preferably, frusto-conical, surfaces. Vanes 60 are useful not only from a structural point of view but also to assist in removal of pocket former 56 from the concrete structure.

FIG. 4 shows a hollow threaded mounting tube 44 for attachment of the anchor plate assembly to the pour form 99. In operation a nut 66 is threaded onto the outside of one end of the mounting tube 44 and the opposite end is then inserted serially through collar 20, bore 30, collar 28, pocket former 56 and form 99 so that nut 66 rests against anchor plate 12 inside cylindrical collar 20. Once the mounting tube 44 is so inserted, another nut 66 can be threaded onto the end of the tube 44 that extends out of form 99 for the purpose of mounting the anchor plate assembly to form 99. Tensioning tendon 14 will pass through this assembly and cap 38 will be frictionally attached to cylindrical collar 20 with the tendon therethrough. Once the pouring and tensioning steps are accomplished and form 99 is removed, threaded mounting tube 44 can be removed simply by unthreading the tube from nut 66 that remains inside capped cylindrical collar 20. Thereafter, pocket former 56 is loosened from the surrounding concrete and pulled out of its pocket. The pocket so formed permits a cap 38 to frictionally engage the outside surface of collar 28.

It may be seen that the tendon 14 itself is constructed with a protective sheath 62. The sheath 62 is cut away in the portion of the tendon 14 that engages the anchor plate 12, as shown in FIGS. 1-3. This is to allow tensioning and/or placement of securement wedges 63 within the bore 30 of the anchor plate 12. The wedges 63 are tapered as is the bore of the anchor plate 12 for securing the tendon 14 against movement after the post-tensioning step. The unsheathed strands of tendon 14 are placed in direct engagement with the anchoring wedges 63 as is conventional in such constructions.

While the invention has been described in detail with particular reference to the preferred embodiment thereof, it will be understood that variations and modifications can be effected within the spirit and scope of the invention as previously described and as defined by the claims.

What is claimed is:

1. A post-tensioning anchor system having a tensioning tendon therethrough for securement in a concrete structure having a pour form, comprising:

(a) an anchor plate having first and second faces, disposed opposite of each other;

(b) the anchor plate further being constructed with a central bore formed therethrough, the bore having a first single cylindrical collar formed on the first face and a second single cylindrical collar formed on the second face, the first and second cylindrical collars being concentrically and peripherally aligned one with the other and having substantially equivalent outside diameters;

(c) a cap adapted for engagement with either of the first or second collars for extension outwardly therefrom and capable of receiving the tendon therethrough, the first and second collars each having an outside diameter adapted for the frictional engagement of the cap therewith for the sealing of the tendon therein.

2. The system of claim 1, further comprising a tubular member adapted for frictional engagement with the cap for extension outwardly therefrom and capable of receiving the tendon therethrough.

3. The system of claim 1, further comprising a hollow threaded mounting tube for attachment of the anchor plate assembly to a pour form.

4. The system of claim 1, further comprising a pocket former engaged with a face of the anchor plate for forming a space in the poured concrete around the outside of the cylindrical collar on that face to permit engagement of the cap thereon after disengaging the pocket former from the face of the anchor plate.

5. A post-tensioning anchor system having a tensioning tendon therethrough for securement in a concrete structure having a pour form, comprising:

(a) an anchor plate having first and second faces, disposed opposite of each other;

(b) the anchor plate further being constructed with a central bore formed therethrough, the bore having a first single cylindrical collar formed on the first face and a second single cylindrical collar formed on the second face, the first and second cylindrical collars being concentrically and peripherally aligned one with the other and having substantially equivalent outside diameters;

(c) a cap adapted for engagement with either of the first or second collars for extension outwardly therefrom and capable of receiving the tendon therethrough, the first and second collars each having an outside diameter adapted for the frictional engagement of the cap therewith for the sealing of the tendon therein;

(d) a tubular member adapted for frictional engagement with the cap for extension outwardly therefrom and capable of receiving the tendon therethrough, wherein the cap comprises a unitary construction having:

a cylindrical cup shaped region having an inside diameter adapted for frictional engagement with the outside diameter of the cylindrical collar on a face of the anchor plate; and a hollow tubular region in communication with the cup shaped region, concentrically aligned herewith and extending outwardly therefrom, the hollow tubular region having an inside diameter sufficient to receive the tensioning tendon therethrough and an outside diameter adapted to frictionally engage the tubular member.

6. A post-tensioning anchor system having a tensioning tendon therethrough for securement in a concrete structure having a pour form, comprising:

(a) an anchor plate having first and second faces, disposed opposite of each other;

(b) the anchor plate further being constructed with a central bore formed therethrough, the bore having a first single cylindrical collar formed on the first face and a second single cylindrical collar formed on the second face, the first and second cylindrical collars being concentrically and peripherally aligned one with the other and having substantially equivalent outside diameters;

(c) a cap adapted for engagement with either of the first or second collars for extension outwardly therefrom and capable of receiving the tendon therethrough, the first and second collars each having an outside diameter adapted for the frictional engagement of the cap therewith for the sealing of the tendon therein;

(d) a tubular member adapted for frictional engagement with the cap for extension outwardly therefrom and capable of receiving the tendon therethrough, wherein the cap comprises a unitary construction having:

a cylindrical cup shaped region having an inside diameter adapted for frictional engagement with the outside diameter of the cylindrical collar on a face of the anchor plate; and a hollow tubular region in communication with the cup shaped region, concentrically aligned herewith and extending outwardly therefrom, the hollow tubular region having an inside diameter sufficient to receive the tensioning tendon therethrough and an outside diameter adapted to frictionally engage the tubular member;

wherein the cylindrical cup shaped region further comprises an annular ridge formed on the inside diameter thereof for increasing the friction between the cap and the outside diameter of the collar.

7. The system of claim 2, wherein the cap comprises a unitary construction having:

(a) a cylindrical cup shaped region having an inside diameter adapted for frictional engagement with the outside diameter of the cylindrical collar on a face of the anchor plate; and (b) a hollow tubular region in communication with the cup shaped region, concentrically aligned herewith and extending outwardly therefrom, the hollow tubular region having an inside diameter sufficient to receive the tensioning tendon therethrough and an outside diameter adapted to frictionally engage the tubular member.

8. The system of claim 5, wherein the cylindrical cup shaped region further comprises an annular ridge formed on the inside face thereof for increasing the friction between the cap and the outside diameter of the collar.

9. A post-tensioning anchor system having a tensioning tendon therethrough for securement in a concrete structure having a pour form, comprising:

(a) an anchor plate having first and second faces, disposed opposite of each other;

(b) the anchor plate further being constructed with a central bore formed therethrough, the bore having a first single cylindrical collar formed on the first face and a second single cylindrical collar formed on the second face, the first and second cylindrical collars being concentrically and peripherally aligned one with the other and having substantially equivalent outside diameters;

(c) a cap adapted for engagement with either of the first or second collars for extension outwardly therefrom and capable of receiving the tendon therethrough, the first and second collars each having an outside diameter adapted for the frictional engagement of the cap therewith for the sealing of the tendon therein;

(d) a gusset tapering downwardly from the outside diameter of a collar, adapted for the frictional engagement of the cap therewith, on a face of the anchor plate.

10. The system of claim 9, further comprising a tubular member adapted for frictional engagement with the cap for extension outwardly therefrom and capable of receiving the tendon therethrough.

11. The system of claim 9, further comprising a hollow threaded mounting tube for attachment of the anchor plate assembly to a pour form.

12. The system of claim 9, further comprising a pocket former engaged with a face of the anchor plate for forming a space in the poured concrete around the outside of the cylindrical collar on that face to permit engagement of the cap thereon after disengaging the pocket former from the face of the anchor plate.

13. The system of claim 10, wherein the cap comprises a unitary construction having:

(a) a cylindrical cup shaped region having an inside diameter adapted for frictional engagement with the outside diameter of the cylindrical collar on a face of the anchor plate; and (b) a hollow tubular region in communication with the cup shaped region, concentrically aligned therewith and extending outwardly therefrom, the hollow tubular region having an inside diameter sufficient to receive the tensioning tendon therethrough and an outside diameter adapted to frictionally engage the tubular member.

14. The system of claim 13, wherein the cylindrical cup shaped region further comprises an annular ridge formed on the inside diameter thereof for increasing the friction between the cap and the outside diameter of the collar.

15. A post-tensioning anchor system having a tensioning tendon therethrough for securement in a concrete structure having a pour form, comprising:

(a) an anchor plate having first and second faces, disposed opposite of each other;

(b) the anchor plate further being constructed with a central bore formed therethrough, the bore having a first single cylindrical collar formed on the first face and a second single cylindrical collar formed on the second face, the first and second cylindrical collars being concentrically and peripherally aligned one with the other and having substantially equivalent outside diameters;

(c) a cap adapted for engagement with either of the first or second collars for extension outwardly therefrom and capable of receiving the tendon therethrough, the first and second collars each having an outside diameter adapted for the frictional engagement of the cap therewith for the sealing of the tendon therein, wherein the outside diameter of each of the first and second collars, adapted for the frictional engagement of the cap therewith, joins the first and second face, respectively, of the anchor plate.

16. The system of claim 15, further comprising a tubular member adapted for frictional engagement with the cap for extension outwardly therefrom and capable of receiving the tendon therethrough.

17. The system of claim 15, further comprising a hollow threaded mounting tube for attachment of the anchor plate assembly to a pour form.

18. The system of claim 15, further comprising a pocket former engaged with a face of the anchor plate for forming a space in the poured concrete around the outside of the cylindrical collar on said face to permit engagement of the cap thereon after disengaging the pocket former from the face of the anchor plate.

19. The system of claim 16, wherein the cap comprises a unitary construction having:

(a) a cylindrical cup shaped region having an inside diameter adapted for frictional engagement with the outside diameter of the cylindrical collar on a face of the anchor plate; and (b) a hollow tubular region in communication with the cup shaped region, concentrically aligned therewith and extending outwardly therefrom, the hollow tubular region having an inside diameter sufficient to receive the tensioning tendon therethrough and an outside diameter adapted to frictionally engage the tubular member.

20. The system of claim 19, wherein the cylindrical cup shaped region further comprises an annular ridge formed on the inside diameter thereof for increasing the friction between the cap and the outside diameter of the collar.

* * * * *